US008885856B2

(12) United States Patent
Sacha

(10) Patent No.: US 8,885,856 B2
(45) Date of Patent: Nov. 11, 2014

(54) HEARING AID WITH INTEGRATED FLEXIBLE DISPLAY AND TOUCH SENSOR

(71) Applicant: Starkey Laboratories, Inc., Eden Prairie, MN (US)

(72) Inventor: Michael Karl Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/718,858

(22) Filed: Dec. 18, 2012

(65) Prior Publication Data

US 2013/0195298 A1 Aug. 1, 2013

Related U.S. Application Data

(60) Provisional application No. 61/580,926, filed on Dec. 28, 2011.

(51) Int. Cl.
*H04R 25/00* (2006.01)

(52) U.S. Cl.
CPC ..... *H04R 25/43* (2013.01); *H04R 2225/61* (2013.01); *H04R 25/65* (2013.01)
USPC ..... 381/314; 381/312; 381/322; 381/323; 381/324; 381/329

(58) Field of Classification Search
USPC ..... 381/312–331
See application file for complete search history.

(56) References Cited

U.S. PATENT DOCUMENTS

| | | | | |
|---|---|---|---|---|
| 2007/0071264 | A1* | 3/2007 | Baechler et al. | 381/315 |
| 2008/0303782 | A1* | 12/2008 | Grant et al. | 345/156 |
| 2009/0061115 | A1* | 3/2009 | Wang et al. | 428/1.1 |
| 2010/0119093 | A1* | 5/2010 | Uzuanis et al. | 381/312 |
| 2010/0254540 | A1* | 10/2010 | Bang | 381/60 |

* cited by examiner

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

A user interface incorporated onto a hearing aid includes flexible hybrid component integrating a touch sensor into a bendable display. The touch sensor, such as a capacitive sensor, includes one or more sensor elements allowing a user to control operation of the hearing aid by touching. The bendable display presents information related to the operation of the hearing aid to the user.

24 Claims, 7 Drawing Sheets

HEARING AID WITH INTEGRATED FLEXIBLE DISPLAY AND TOUCH SENSOR

CLAIM OF PRIORITY

The present application claims the benefit under 35 U.S.C. §119(e) of U.S. Provisional Patent Application Ser. No. 61/580,926, filed on Dec. 28, 2011, which is incorporated herein by reference in its entirety.

TECHNICAL FIELD

This document relates generally to hearing assistance systems and more particularly to a hearing aid including a flexible display integrated with a touch sensor.

BACKGROUND

Hearing aids are used to assist patients suffering hearing loss by transmitting amplified sounds to ear canals. In one example, a hearing aid is worn in and/or around a patient's ear. Patients prefer that their hearing aids are minimally visible or invisible, do not interfere with their daily activities, and easy to control (such as turning on/off and adjusting sound volume). A user interface incorporated onto a hearing aid provides the patient with some control of the hearing aid operation, such as turning the hearing aid on/off and adjusting sound volume. The functionality of such a user interface is limited by design constraints such as the limited space and power available from the hearing aid. Thus, there is a need for a user interface providing a user with improved controllability, ease of use, and/or appearance of a hearing aid while being compatible with power and other constraints of the hearing aid.

SUMMARY

A user interface incorporated onto a hearing aid includes a flexible hybrid component integrating a touch sensor into a bendable display. The touch sensor, such as a capacitive sensor, includes one or more sensor elements allowing a user to control operation of the hearing aid by touching. The bendable display presents information related to the operation of the hearing aid.

In one embodiment, a hearing aid includes a hearing aid circuit, a hearing aid housing, and a user interface. The hearing aid circuit includes a microphone, a receiver, and a processing circuit coupled between the microphone and the receiver. The hearing aid housing contains the hearing aid circuit. The user interface includes a bendable display. The bendable display includes a display layer and a sensor layer. The display layer is configured to dynamically display information indicative of operation of the hearing aid. The sensor layer is on the display layer and includes a capacitive sensor configured to sense touching.

In one embodiment, a hearing aid includes a hearing aid circuit, a hearing aid housing, and a user interface. The hearing aid circuit includes a microphone, a receiver, and a processing circuit coupled between the microphone and the receiver. The hearing aid housing contains the hearing aid circuit. The user interface includes a flexible hybrid user interface component incorporated onto the hearing aid housing. The flexible hybrid user interface component includes a bendable display and a capacitive sensor integrated into the display. The display is configured to dynamically display information indicative of operation of the hearing aid circuit. The capacitive sensor is configured to receive user commands in one or more forms of touching movements.

In one embodiment, a method is provided for interactions between a hearing aid and a user. The hearing aid is provided with a flexible hybrid user interface component that includes a bendable display and a capacitive sensor integrated into the display. Information indicative of operation of the hearing aid are dynamically displayed using the bendable display. User commands are received by sensing one or more forms of touching using the capacitive sensor.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing aid including a flexible hybrid user interface component integrating a touch sensor into a bendable display. The touch sensor, such as a capacitive sensor, includes one or more sensor elements allowing a user to control operation of the hearing aid through one or more forms of touching movements. The bendable display presents information related to the operation of the hearing aid to the user. In one embodiment, the bendable display may also function as a decorative feature.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that BTE type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally. It is understood that other hearing assistance devices not expressly stated herein may be used in conjunction with the present subject matter.

Figure 1:
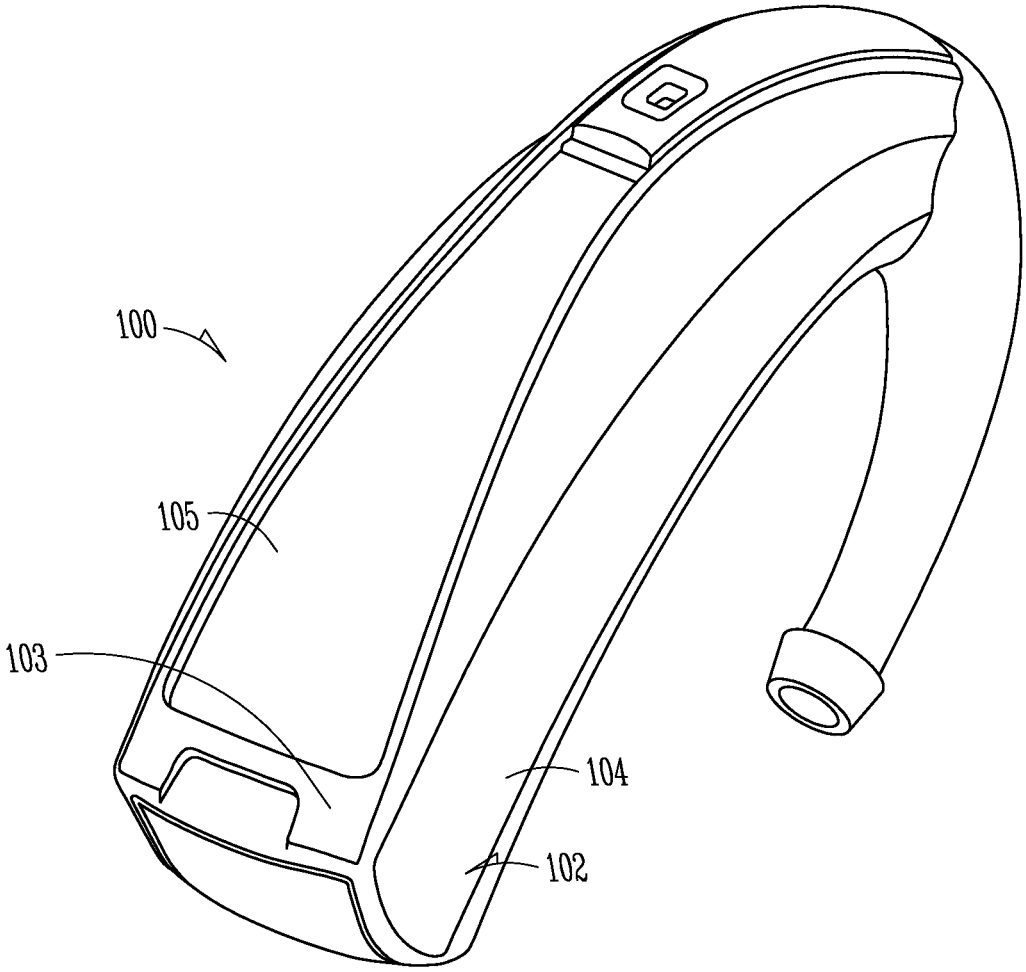
FIG. 1 is an illustration of an embodiment of a hearing aid including a hybrid user interface component.

FIG. 1 is an illustration of an embodiment of a hearing aid 100 including a hybrid user interface component 105. Hearing aid 100 includes a hearing aid housing 102 that contains a circuit. Hearing aid housing 102 includes a top surface 103 and a plurality of side surfaces 104. The circuit is discussed below with reference to FIG. 2. Hearing aid 100 is provided with hybrid user interface component 105 as its user interface, or a portion thereof, which allows for interactions between hearing aid 100 and its user. In various embodiments, hybrid user interface component 105 is incorporated onto hearing aid housing 102 and includes a display and a touch sensor integrated into the display. Information indicative of operation of hearing aid 100 is dynamically displayed using the display. User commands are received by sensing one or more forms of touching movements using the touch sensor.

In various embodiments, the touch sensor is a capacitive sensor including one or more sensor elements that are substantially bendable and transparent. Hybrid user interface component 105 is flexible and includes a bendable display, with the capacitive sensor integrated into the bendable display.

In various embodiments, the touch sensor is a piezoelectric sensor including one or more sensor elements that are substantially bendable and transparent. Hybrid user interface component 105 is flexible and includes a bendable display, with the piezoelectric sensor integrated into the bendable display. Different piezoelectric technologies can be employed, including but not limited to, active vibrating piezoelectric technologies and strain measurement piezoelectric technologies.

In various other embodiments, the touch sensor may be any type of sensor that is substantially bendable and transparent. Other technologies include, but are not limited to, QTC (quantum tunneling composite), or other pressure sensing technologies.

In the illustrated embodiment, hybrid user interface component 105 is incorporated onto top surface 103 of hearing aid housing 102. Hearing aid 100 is illustrated as a BTE hearing aid as an example, with top surface 103 being the surface that faces forward/upward and is most visible when hearing aid 100 is being worn on an ear of the user. The bendable display encompasses a substantial portion of top surface 103. In one embodiment, the bendable display encompasses approximately the entire top surface 103.

Figure 2:
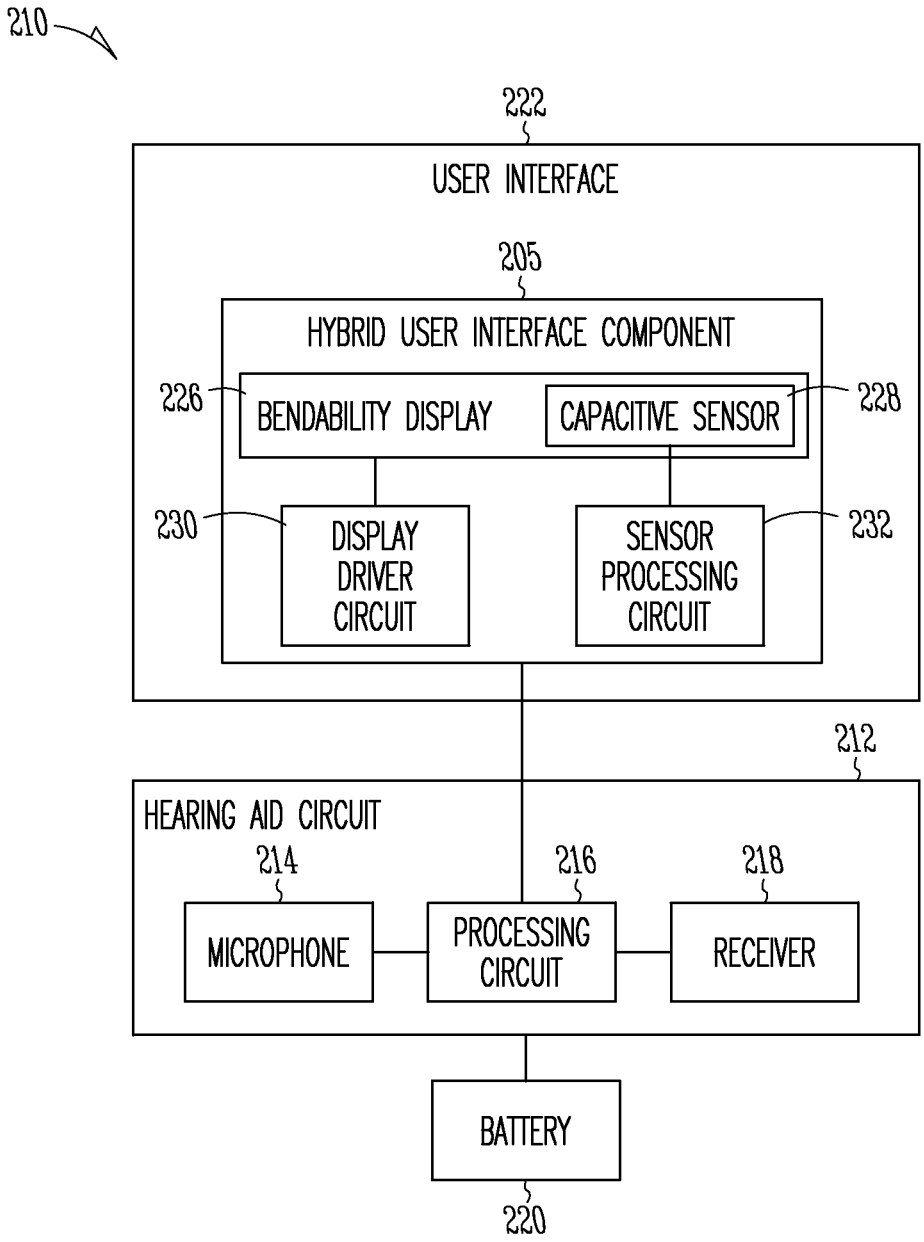
FIG. 2 is a block diagram illustrating an embodiment of a circuit of the hearing aid.

FIG. 2 is a block diagram illustrating an embodiment of a circuit 210 of hearing aid 100. Circuit 210 includes a hearing aid circuit 212, a battery 220, and a user interface 222. Hearing aid circuit 212 includes a microphone 214, a receiver (speaker) 218, and a processing circuit 216 coupled between microphone 214 and receiver 218. Battery 220 provides hearing aid 100 with power for its operation. User interface 222 allows for interactions between hearing aid 100 and the user, and includes a hybrid user interface component 205, which is an embodiment of hybrid user interface component 105. In various embodiments, hearing aid circuit 212 and battery 220 are housed in hearing aid housing 102. User interface 222 is incorporated onto hearing aid housing 102. In various embodiments, portions of user interface 222 are also housed in hearing aid housing 102.

In various embodiments, hybrid user interface component 205 is flexible and includes a bendable display 226. A capacitive sensor 228 is integrated into display 226. Display 226 dynamically displays information indicative of operation of hearing aid circuit 212 and/or status of batter 220. Capacitive sensor 228 receives user commands in one or more forms of touching, such as tapping, sweeping, and rheostat movements.

User interface 222 also includes a display driver circuit 230 to control display 226 and a sensor processing circuit 232 to process signals sensed by capacitive sensor 228. In the illustrated embodiment, display driver circuit 230 and sensor processing circuit 232 are integrated into flexible hybrid user interface component 205. In another embodiment, display driver circuit 230 and sensor processing circuit 232 are external to flexible hybrid user interface component 205. In another embodiment, one of display driver circuit 230 and sensor processing circuit 232 is integrated into flexible hybrid user interface component 205. In one embodiment, flexible hybrid user interface component 205 is constructed as a single flexible integrated circuit (IC).

Bendable display 226 has power consumption and size suitable for use in a hearing aid. In various embodiments, display 226 includes a segment display including alphanumeric characters, a bar graph display, a combination of the segment display and the bar graph display, or any other forms of display suitable for dynamically presenting information indicative of operation of hearing aid 100. In various embodiments, the presented information is indicative of operation of hearing aid circuit 212, status of battery 220, and/or user interface 222. Examples of such information includes sound volume control setting, status of equalizer, status of memory, status of battery 220 such as state of recharge or energy level, status of communication (pairing) with a hearing aid base, time such as time of utilization of hearing aid 100, and results of sound environment monitoring by hearing aid 100 such as per Safety and Health Administration (OSHA) regulations. In one embodiment, display 226 functions as a decorative feature, instead of or in addition to displaying information indicative of operation of hearing aid 100. In one embodiment, display 226 accommodates customizable schemes such as coloring and/or patterning schemes. User interface 222 allows the user to select colors and/or patterns to be displayed. This feature may be particular valuable in pediatric use of hearing aid 100.

Capacitive sensor 228 is integrated into bendable display 226 and includes one or more sensor elements. In various embodiments, the one or more sensor elements are mounted on a displaying component of display 226 or buried in the displaying component to sense touching of a surface of display 226 by the user. In various embodiments, capacitive sensor 228 is substantially transparent and flexible (bendable). The one or more sensor elements includes electrodes made of a material that is mechanically flexible (bendable), optically transparent, and electrically conductive. Example of such a material includes Indium Tin Oxide (ITO).

In one embodiment, capacitive sensor 228 including a plurality of sensor elements. Sensor processing circuit 232 is programmed to allow parameters of hearing aid 100 to be accessed and modified by the user using capacitive sensor 228. This allows the parameters to be accessed and modified at the hearing aid level rather than the base/programmer level, thereby eliminating the need for using a hearing aid base/programmer to adjust certain parameters and allowing the user to turn hearing aid 100 on/off and/or adjusting settings of hearing aid 100 wherever desirable. In one embodiment, display 226 presents information indicative of reaction of capacitive sensor 228 to the user's touching movements to guide the user in adjusting the parameters of hearing aid 100.

Figure 3:
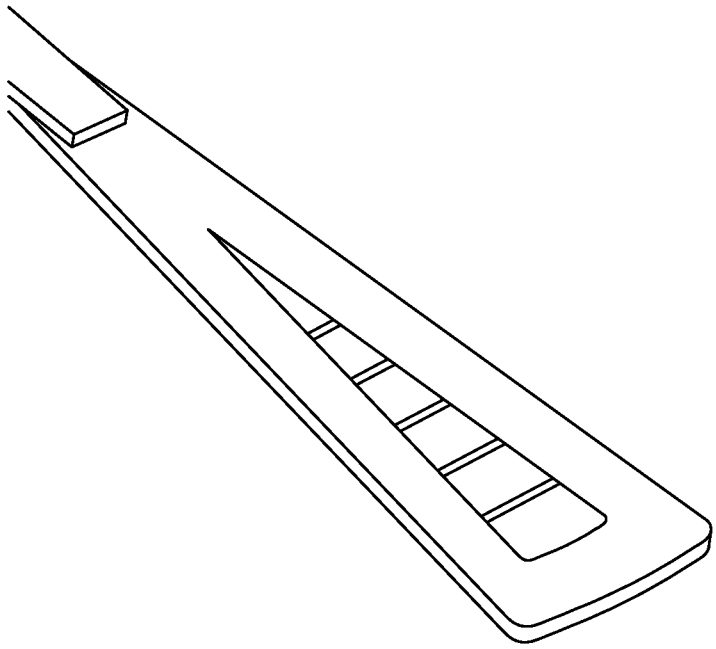
FIG. 3 is an illustration of an example of the hybrid user interface component.

FIG. 3 is an illustration of an example of hybrid user interface component 105 or 205. Hybrid user interface component 105 or 205 represents an improvement over trimmer (potentiometer) equipped hearing aids that are more likely suffer from reliability issues because of the trimmer potentiometer array. With multiple sensor elements, hybrid user interface component 205 may function as a digital "potentiometer" with display 226 functioning to guide the touching, and may also allow improved discrimination of water/moisture from actual touching by sensor processing circuit 232.

Figure 4:
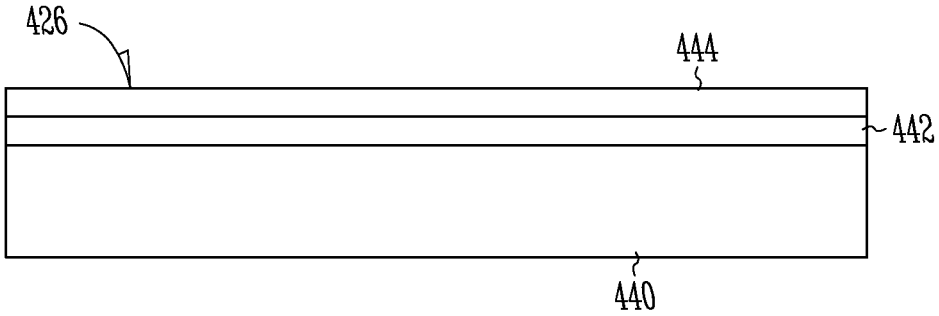
FIG. 4 is a cross-sectional view illustrating an embodiment of a bendable display of the hybrid user interface component.

FIG. 4 is a cross-sectional view illustrating an embodiment of bendable display 426, which represents an embodiment of bendable display 226. Display 426 includes a display layer 440 and a sensor layer 442. Display layer 440 is configured to dynamically display the information indicative of operation of hearing aid 100. Sensor layer 442 is on display layer 440 and includes capacitive sensor 228. In one embodiment, display 426 also includes a transparent cover layer 444 for protection of sensor layer 442 and display layer 440.

Figure 5:
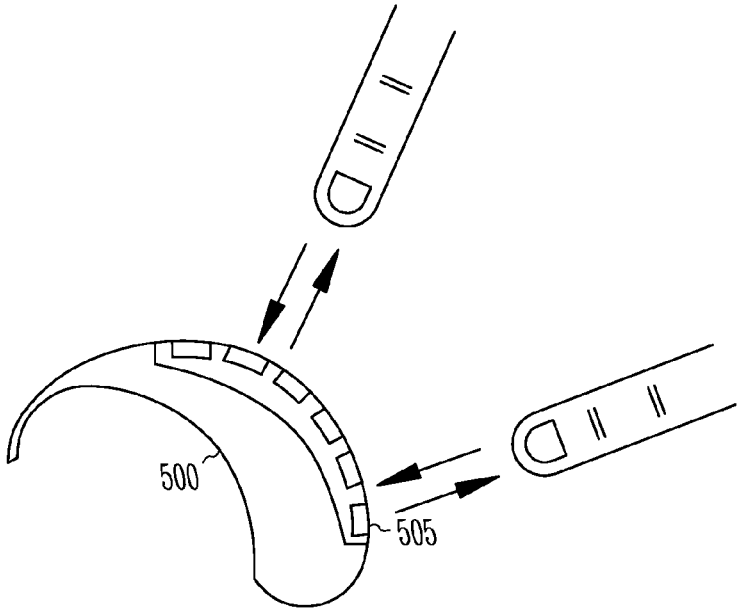
FIGS. 5-7 are illustrations of embodiments of controlling operation of the hearing aid using a capacitive sensor of the hybrid user interface component.
Figure 6A:
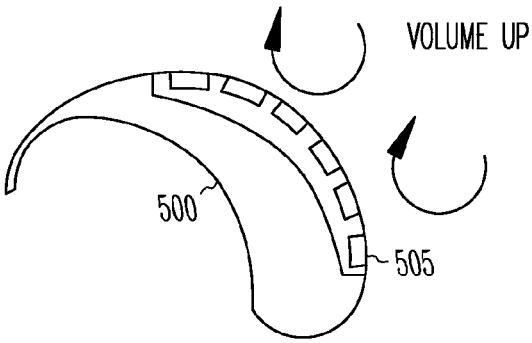
Figure 6B:
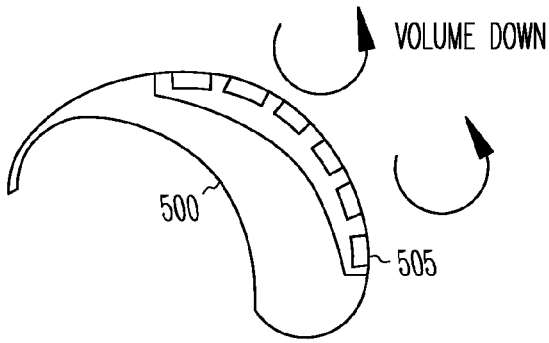
Figure 7:
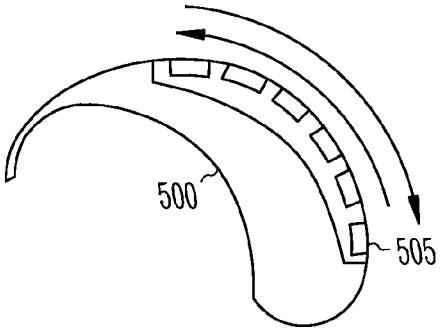

FIGS. 5-7 are illustrations of embodiments of controlling operation of a hearing aid 500 using the capacitive sensor of a hybrid user interface component 505 through various touching movements. Hearing aid 500 represents an embodiment of hearing aid 100 constructed as a BTE hearing aid. Hybrid user interface component 505 represents hybrid user interface component 105 or 205 when configured for use with the BTE hearing aid. In various embodiments, the various touching movements allows for control of various parameters of hearing aid 500. FIG. 5 illustrates tapping movements. FIG. 6 illustrates sweeping movements. FIG. 7 illustrates rheostat movements. For example, the tapping movements may be used as user commands for turning hearing aid 500 on/off, and the sweeping or rheostat movements may be used as user commands for turning the sound volume up and down.

Figure 8:
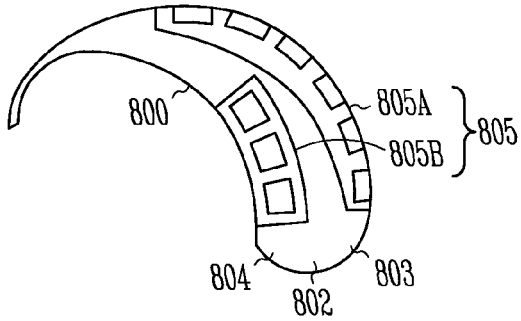
FIG. 8 is an illustration of an embodiment of a behind-the-ear (BTE) hearing aid including a hybrid user interface component.

FIG. 8 is an illustration of an embodiment of a BTE hearing aid 800 including a hybrid user interface component 805. Hearing aid 800 represents an embodiment of hearing aid 100 or 500 and has a hearing aid housing 802 for a BTE hearing aid. Hearing aid housing 802 includes a top surface 803 and a plurality of side surfaces 804. Top surface 803 faces upward when BTE hearing aid 800 is worn on the user's ear during use. Hybrid user interface component 805 represents an embodiment of hybrid user interface component 105 or 205 and includes a top display 805A incorporated onto top surface 803 and one or more side displays 805B (one side display shown in FIG. 8) each incorporated into a side surface of the plurality of side surfaces 804. In various embodiments, the one or more side displays are each incorporated into a side surface of the plurality of side surfaces 804 that is visible when hearing aid 800 is being worn by the user. In various embodiments, the top display and the one or more side displays each display one or more parameters of hearing aid 800 and/or function as the decorative feature of hearing aid 800. In one embodiment, top display 805A displays the one or more parameters, and one or more side displays 805B function as the decorative feature. In another embodiment, top display 805A and one or more side displays 805B both display the one or more parameters, and one or more side displays 805B also function as the decorative feature.

Figure 9:
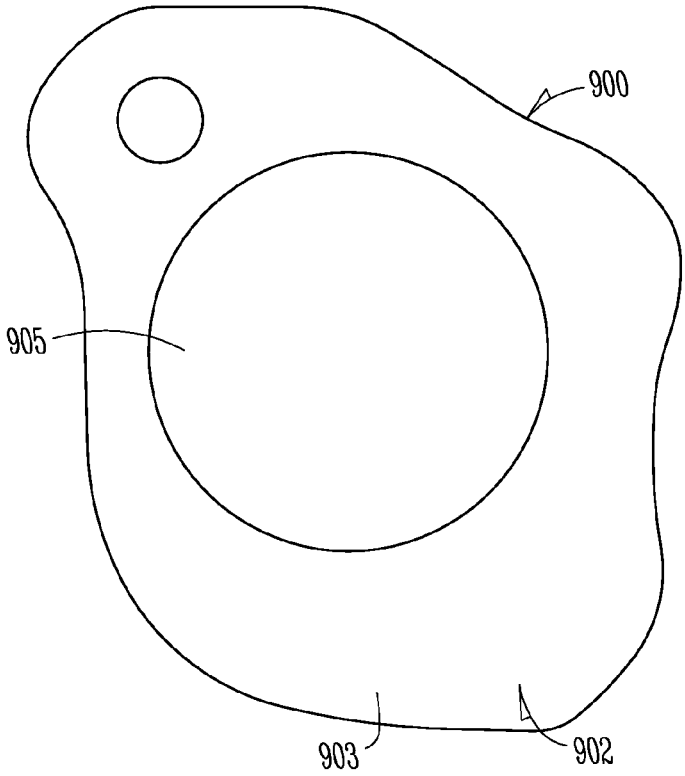
FIG. 9 is an illustration of an embodiment of an in-the-ear (ITE) hearing aid including a hybrid user interface component.

FIG. 9 is an illustration showing an embodiment of an ITE hearing aid 900 including a hybrid user interface component 905. Hearing aid 900 represents an embodiment of hearing aid 100 or 500 and has a hearing aid housing 902 for an ITE hearing aid. Hearing aid housing 902 includes a top surface 903 shown in FIG. 9 as the faceplate of hearing aid 900. Top surface 903 faces outward when hearing aid 900 is being placed in an ear of the user during use. Hybrid user interface component 905 represents an embodiment of hybrid user interface component 105 or 205 and is incorporated onto top surface 902. In the illustrated embodiment, hearing aid 900 is powered by a rechargeable battery and does not have a battery door on top surface 903.

FIGS. 10-13 are illustrations of various embodiments of a hybrid user interface component with multiple touch areas implemented in a hearing aid. These illustrated embodiments are presented by way of example, and not by way of limitation, of how the hybrid user interface component may be arranged on the hearing aid and used.

Figure 10:
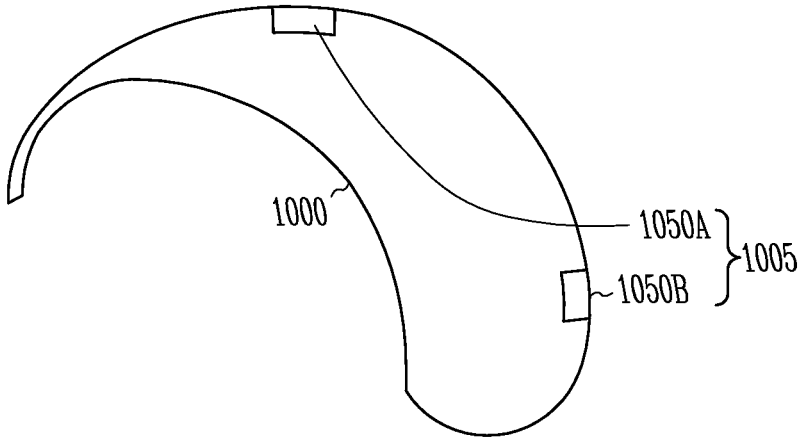
FIG. 10 is an illustration of an embodiment a hybrid user interface component with multiple touch areas implemented in a BTE hearing aid.

FIG. 10 is an illustration of an embodiment of a hybrid user interface component 1005 implemented in a BTE hearing aid 1000. Hybrid user interface component 1005 represents an embodiment of hybrid user interface component 105 or 205. Hearing aid 1000 represents an embodiment of hearing aid 100 constructed as a BTE hearing aid. In the illustrated embodiment, hybrid user interface component 1005 includes a touch area 1050A to receive a parameter selection and a touch area 1050B to allow adjustment of value of the selected parameter. Touch areas 1050A and 1050B each include a sensor element of capacitive sensor 228. In one example, the user touches (or taps) touch area 1050A to activate parameter adjustment or cycle through adjustable parameters, and touches (or taps) touch area 1050B to change the value of the parameter.

Figure 11:
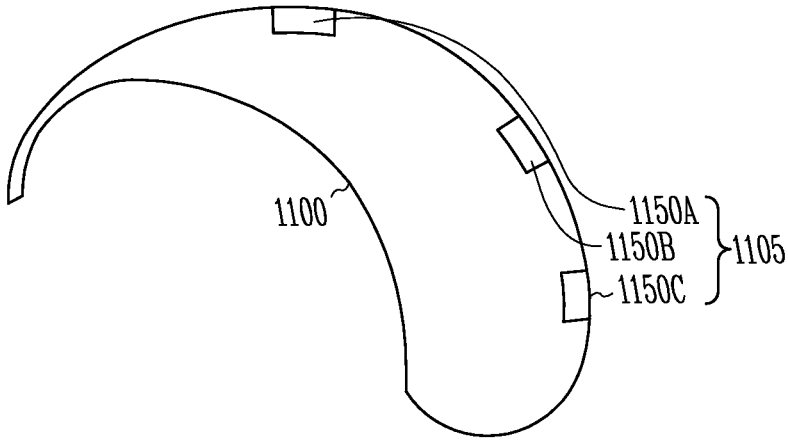
FIG. 11 is an illustration of another embodiment a hybrid user interface component with multiple touch areas implemented in a BTE hearing aid.

FIG. 11 is an illustration of another embodiment of a hybrid user interface component 1105 implemented in a BTE hearing aid 1100. Hybrid user interface component 1105 represents an embodiment of hybrid user interface component 105 or 205. Hearing aid 1100 represents an embodiment of hearing aid 100 constructed as a BTE hearing aid. In the illustrated embodiment, hybrid user interface component 1105 includes a touch area 1150A to receive a parameter selection and a pair of touch areas 1150B-C to allow adjustment of value of the selected parameter. Touch areas 1150A-C each include a sensor element of capacitive sensor 228. In one example, the user touches (or taps) touch area 1150A to activate parameter adjustment or cycle through adjustable parameters, touches (or taps) touch area 1150B to increase the value of the parameter, and touches (or taps) touch area 1150C to decrease the value of the parameter.

Figure 12:
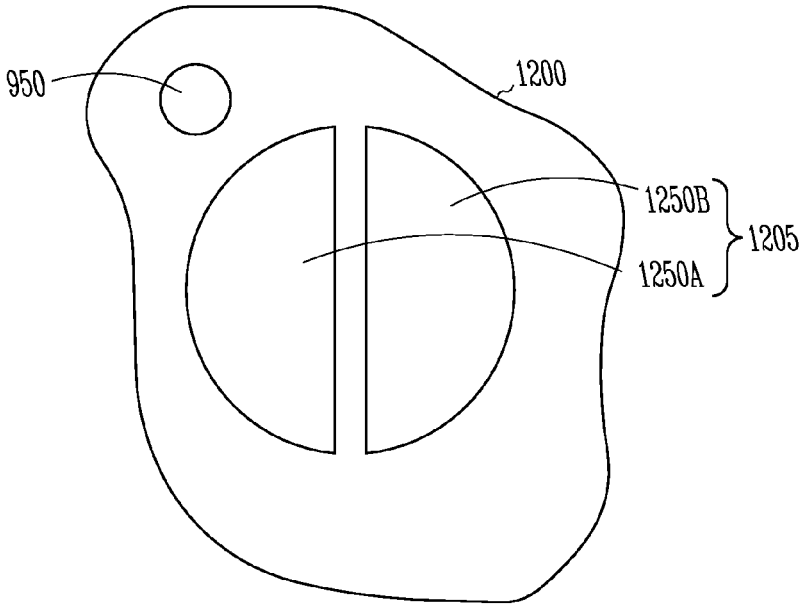
FIG. 12 is an illustration of an embodiment a hybrid user interface component with multiple touch areas implemented in an ITE hearing aid.

FIG. 12 is an illustration of an embodiment a hybrid user interface component 1205 implemented in an ITE hearing aid 1200. Hybrid user interface component 1205 represents an embodiment of hybrid user interface component 105 or 205. Hearing aid 1200 represents an embodiment of hearing aid 100 constructed as an ITE hearing aid. In the illustrated embodiment, hybrid user interface component 1205 includes a touch area 1250A to receive a parameter selection and a touch area 1250B to allow adjustment of value of the selected parameter. Touch areas 1250A and 1250B each include a sensor element of capacitive sensor 228. In one example, the user touches (or taps) touch area 1250A to activate parameter adjustment or cycle through adjustable parameters, and touches (or taps) touch area 1250B to change the value of the parameter.

Figure 13:
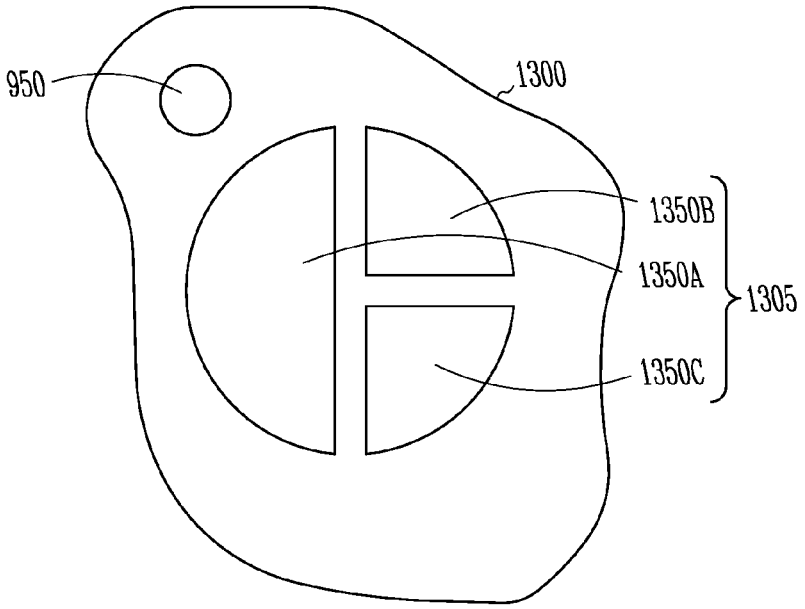
FIG. 13 is an illustration of another embodiment a hybrid user interface component with multiple touch areas implemented in an ITE hearing aid.

FIG. 13 is an illustration of another embodiment a hybrid user interface component 1305 implemented in an ITE hearing aid 1300. Hybrid user interface component 1305 represents an embodiment of hybrid user interface component 105 or 205. Hearing aid 1300 represents an embodiment of hearing aid 100 constructed as an ITE hearing aid. In the illustrated embodiment, hybrid user interface component 1305 includes a touch area 1350A to receive a parameter selection and a pair of touch areas 1350B-C to allow adjustment of value of the selected parameter. Touch areas 1350A-C each include a sensor element of capacitive sensor 228. In one example, the user touches (or taps) touch area 1350A to activate parameter adjustment or cycle through adjustable parameters, touches (or taps) touch area 1350B to increase the value of the parameter, and touches (or taps) touch area 1350C to decrease the value of the parameter.

A bendable display for a hearing aid as discussed above is realized in various embodiments. In various embodiments, an electrochromic material is deposited on a conductive substrate to create a custom display. In various embodiments a display made using electrochromic inks made by NTERA, Inc. These inks are electrochromic (dubbed "NanoChromic"™ by NTERA, Inc.) materials that can be deposited on the substrate. In various embodiments the material is silkscreened on a substrate. In various embodiments, the material is printed using an inkjet printer.

In various embodiments electrophoretic materials are deposited on a conductive substrate. In various embodiments the material is silkscreened on a substrate. In various embodiments, the material is printed using an inkjet printer.

Other displays can be used, such as, for example, a bendable monochrome (gray scale) display made by EM Microelectronic, the Swatch Group Limited, (Biel/Bienne, Switzerland) has a bend radius of approximately 50 millimeters (mm), a thickness of approximately 0.5 mm, an edge seal of approximately 1.7 mm, a supply voltage of approximately 1.5 volts, and a current consumption of less than 1 microampere (μA). This display can be driven by a display driver circuit being integrated circuit (IC) having a voltage supply of approximately 2 volts and a current consumption of approximately 10 μA or less. The IC may be customized by optimizing its size and power ratings for compatibility with a hearing aid powered by a rechargeable battery. Further customization may also include integrating the capacitive sensor, the sensor processing circuit, and/or the display drive circuit with the bendable display to optimize the overall size, and implementing a color display.

In various embodiments, hybrid user interface component 105 and its various embodiments as discussed in this document is used in a hearing aid to provide, for example, (i) product uniqueness (with a dynamic, functional display), (ii) parameter indication (using alphanumeric and/or bar graph), (iii) battery status indication, (iv) right/left ear identification (ease of use), (v) pairing indication, i.e., indication of wireless connectivity between the hearing aid and the hearing aid base, and (vi) hearing aid programming (without base/programmer). In various embodiments of pediatric use, hybrid user interface component 105 and its various embodiments as discussed in this document is used in a hearing aid to provide a user's parent with visual cues including, for example, (i) parameter indication (using alphanumeric and/or bar graph), (ii) battery status indication, (iii) pairing indication, i.e., indication of wireless connectivity between the hearing aid and the hearing aid base, and (iv) hearing aid on/active indication (such as using moving display patterns) to help ensure proper and safe use of the hearing aid by a minor child. In one embodiment, hybrid user interface component 105 and its various embodiments as discussed in this document is used in a hearing aid as a decorative feature, with display schemes, such as colors and patterns, selectable by the minor child user, thereby encouraging the use of the hearing aid.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a hearing aid circuit including a microphone, a receiver, and a processing circuit coupled between the microphone and the receiver;

a hearing aid housing containing the hearing aid circuit, the hearing aid housing being an in-the-ear (ITE) housing configured for an ITE hearing aid, a behind-the-ear (BTE) housing configured for a BTE hearing aid, or a receiver-in-canal (RIC) housing configured for an RIC hearing aid; and a user interface coupled to the processing circuit, incorporated onto the hearing aid housing, and including a bendable display including:

a display layer configured to dynamically display information indicative of operation of the hearing aid; and a sensor layer on the display layer, the sensor layer including a capacitive sensor configured to sense touching.

2. The hearing aid of claim 1, wherein the bendable display further comprises a cover layer on the sensor layer for protection of the sensor layer and the display layer.

3. The hearing aid of claim 1, wherein the hearing aid housing comprises a top surface and a plurality of side surfaces, and the bendable display comprises a top display encompassing a substantial portion of the top surface.

4. The hearing aid of claim 3, wherein the hearing aid housing is the ITE housing, and the top surface is a surface facing outward when the ITE hearing aid is positioned during use.

5. The hearing aid of claim 3, wherein the hearing aid housing is the BTE housing, and the top surface is a surface facing upward when the BTE hearing aid is positioned during use.

6. The hearing aid of claim 5, wherein the bendable display further comprises one or more side displays each incorporated into a side surface of the plurality of side surfaces.

7. The hearing aid of claim 1, wherein the capacitive sensor comprises one or more sensor elements each including electrodes made of a material that is mechanically flexible, optically transparent, and electrically conductive.

8. The hearing aid of claim 7, wherein the material comprises Indium Tin Oxide (ITO).

9. A hearing aid for a user having an ear, comprising:

a hearing aid circuit including a microphone, a receiver, and a processing circuit coupled between the microphone and the receiver;

a hearing aid housing containing the hearing aid circuit, the hearing aid housing configured to be in or on the ear when the hearing aid is worn by the user; and a user interface including a flexible hybrid user interface component incorporated onto the hearing aid housing, the flexible hybrid user interface component including a bendable display and a capacitive sensor integrated into the display, the display configured to dynamically display information indicative of operation of the hearing aid circuit, the capacitive sensor configured to receive user commands in one or more forms of touching movements.

10. The hearing aid of claim 9, wherein the user interface comprises:

a display driver circuit configured to control the bendable display; and a sensor processing circuit configured to process signals sensed by the capacitive sensor, wherein either one or both of the display driver circuit and the sensor processing circuit are integrated into the flexible hybrid user interface component.

11. The hearing aid of claim 9, wherein the display comprises a segment display including alphanumeric characters, a bar graph display, or a combination of the segment display and the bar graph display.

12. The hearing aid of claim 11, wherein the display is configured to display information indicative of reaction of the capacitive sensor to the one or more forms of touching movements to provide guidance for adjusting settings of the hearing aid.

13. The hearing aid of claim 9, wherein the display is further configured to function as a decorative feature.

14. The hearing aid of claim 13, wherein the display is configured to display customizable schemes.

15. A method for providing interactions between a hearing aid and a user, comprising:

providing the hearing aid with a flexible hybrid user interface component including a bendable display and a capacitive sensor integrated into the display, including incorporating the display into at least one surface of a housing of the hearing aid, the hearing aid configured to be worn in or on an ear of the user;

dynamically displaying information indicative of operation of the hearing aid using the bendable display; and receiving user commands by sensing one or more forms of touching using the capacitive sensor.

16. The method of claim 15, comprising displaying information indicative of reaction of the capacitive sensor to the one or more forms of touching to provide guidance for adjusting settings of the hearing aid.

17. The method of claim 15, comprising displaying one or more decorative features.

18. The method of claim 17, further comprising receiving a user selection of a display scheme and displaying the one or more decorative features according to the display scheme.

19. The method of claim 15, comprising dynamically displaying information indicative of sound volume control setting of the hearing aid.

20. The method of claim 15, comprising dynamically displaying information indicative of status of a battery of the hearing aid.

21. The method of claim 15, comprising dynamically displaying information indicative of status of equalizer or memory of the hearing aid.

22. The method of claim 15, comprising dynamically displaying information indicative of status of communication between the hearing aid and a hearing aid base.

23. The method of claim 15, comprising dynamically displaying information indicative of a time of utilization of the hearing aid.

24. The method of claim 15, comprising dynamically displaying information indicative of results of sound environment monitoring performed by the hearing aid.

* * * * *